United States Patent [19]

Smilow et al.

[11] 4,063,669

[45] Dec. 20, 1977

[54] DISPLAY BELT HANGER

[75] Inventors: George Smilow, Yonkers; Samuel L. Kayen, Elmont, both of N.Y.

[73] Assignee: Berger & Gorin, Inc., New York, N.Y.

[21] Appl. No.: 612,185

[22] Filed: Sept. 10, 1975

[51] Int. Cl.[2] ..... A47J 51/097

[52] U.S. Cl. ..... 223/87; 24/245 R; 24/201 A

[58] Field of Search ..... 223/85, 87, DIG. 1; 211/113, 13, 60 R, 60 A, 71, 73; 248/224; 24/245 FF, 201 A

[56] References Cited

U.S. PATENT DOCUMENTS

| | | | |
|---|---|---|---|
| 846,476 | 3/1907 | Hynard et al. | 24/176 |
| 2,172,681 | 9/1939 | Plaks | 211/113 |
| 2,601,926 | 7/1952 | Speaker et al. | 211/113 |
| 2,884,675 | 5/1959 | Sternschuss | 24/176 X |
| 3,710,996 | 1/1973 | Smilow | 223/87 |
| 3,751,770 | 8/1973 | Italiano | 24/201 A |

*Primary Examiner*—George H. Krizmanich
*Attorney, Agent, or Firm*—Charles E. Temko

[57] ABSTRACT

A belt display device of the type adapted to engage the buckle element of a dress belt, the buckle having a laterally projecting locking stud. The device engages the locking stud in such a manner that when the device is suspended upon a horizontally oriented rail or similar supporting structure adjacent other similarly suspended belts, the free end of the locking stud is prevented from contacting the outer surface of an adjacent buckle thereby avoiding the possibility of marring said surface.

2 Claims, 4 Drawing Figures

DISPLAY BELT HANGER

BACKGROUND OF THE INVENTION

This invention relates generally to the field of apparel display devices of the type disclosed in our prior U.S. Pat. No. 3,710,996 granted Jan. 16, 1973 entitled DISPLAY BELT HANGER. More particularly the invention is directed to an improvement in the device disclosed therein to adapt the same to support belt buckles of other than conventional prong and center bar type buckles.

In recent years, so-called stud and channel type belt buckles have become popular. Such buckles are characterized in the provision of an elongated stud having an enlargement on a free end thereof extending laterally of the plane of a generally planar imperforate buckle body to selectively engage corresponding openings in the strap portion of the belt. While such buckles normally include a wire loop forming a channel to which our previously disclosed belt hanger may be engaged, such engagement permits the stud to remain exposed to possibly mar the outer surface of an adjacent buckle by permitting contact when a plurality of hangers are suspended for display on a common horizontally oriented rod.

SUMMARY OF THE INVENTION

Briefly stated, the invention contemplates the provision of a device generally similar in configuration to that described in our above mentioned patent, and having an additional keyhole-shaped opening for selectively engaging the laterally projecting stud of a stud and channel type belt buckle in such manner that the free end of the stud is enclosed and therefore shielded from contact with the exposed surface of a buckle positioned adjacent said stud when suspended on a common supporting rail or similar supporting device.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
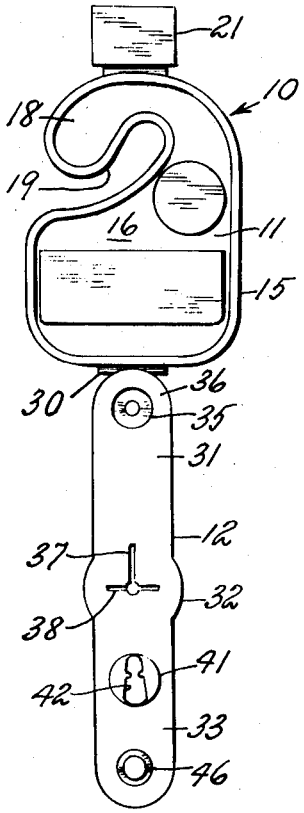
FIG. 1 is a side elevational view of an embodiment of the invention.

In accordance with the invention, the device, generally indicated by reference character 10 comprises broadly: a main body element 11 and a loop-forming element 12. As explained in our above mentioned prior patent, the device is preferably formed as a unitary molding from flexible synthetic resinous material having a limited degree of resilience, as for example polyethylene, or materials having similar properties.

Figure 3:
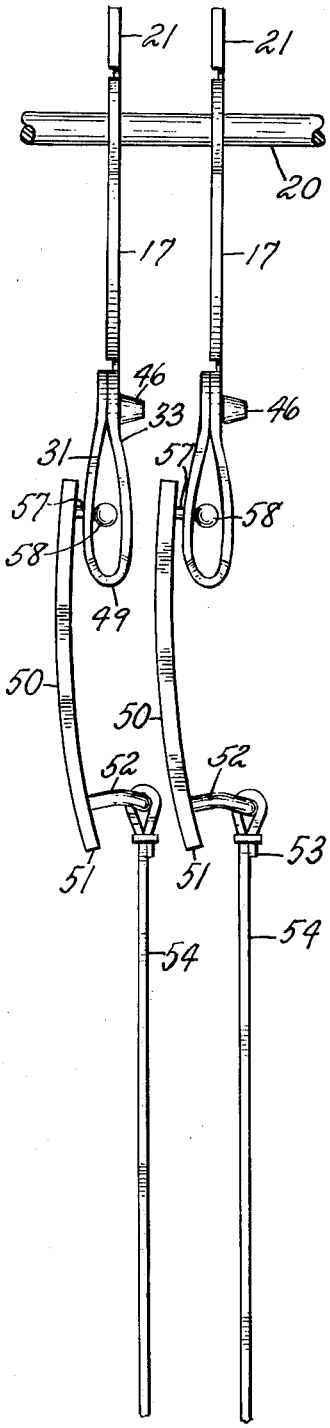
FIG. 3 is an end elevational view showing the device supporting a plurality of belts for display on a common rail.
Figure 4:
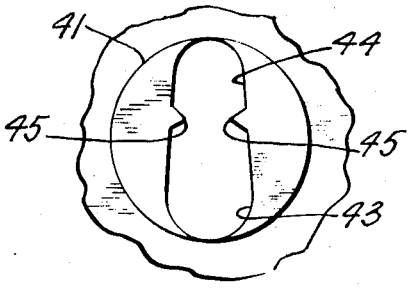
FIG. 4 is an enlarged fragmentary view in elevation corresponding to the lower central portion of FIG. 1.

The main body element 11 is of generally rectangular configuration, and is bounded by a continuous peripheral edge 15, as well as a front surface 16 and a rear surface 17. A hook 18 overlies a correspondingly shaped recess 19 permitting the device to be engaged upon a horizontal rod 20 (FIG. 3) or other similar supporting device. Extending upwardly from the hook 18 is an optional size-indicating tab 21.

The loop-forming element 12 interconnects at one end thereof to a depending tab 30 and includes a first elongated portion 31, a bend portion 32, and a second elongated portion 33. The portion 31 includes a generally circular opening 35 at an upper end 36. The lower end adjacent the bend portion 32 includes a slot-like opening 37 communicating with a transverse opening 38 forming means for engaging the conventional prong and center bar type of belt buckle, with which the device 10 may be selectively used.

Figure 2:
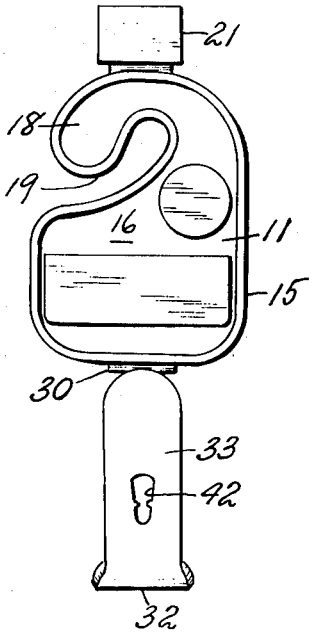
FIG. 2 is a similar view of the embodiment with certain component parts thereof in altered relative position.

The second elongated portion 33 is of configuration generally similar to that of the first portion 31, and includes a generally circular area 41 of increased thickness enclosing a keyhole-shaped through opening 42 including a larger portion 43 and a small portion 44 separated by projections 45. A locking stud 46 engages the opening 35 in a manner as taught in our above mentioned prior patent, and as illustrated in FIG. 2 in the drawing. Normally this engagement is made after the conventional belt buckle has been engaged. Where the device is used in conjunction with stud and channel buckles, the loop 49 may be formed prior to engagement of the buckle.

Referring again to FIG. 3, there is illustrated a plurality of belts 50, each including a buckle 51 of generally planar imperforate configuration, and having a wire channelforming member 52 extending from an inner surface thereof to engage an end loop 53 of a strap member 54 of a belt 50 at one end 55 thereof. Extending from the same inner surface is a laterally projecting stud 57 having an enlargement 58 on the free end thereof adapted to enclose one of a plurality of generally equally spaced openings (not shown) in the strap 54. The configuration of the larger portion 43 of the opening 42 corresponds to the diameter of the enlargement 58, while the configuration of the smaller part 54 of the opening corresponds to the diameter of the stud 57, so that selective engagement is accomplished by inserting the enlargement on the stud through the larger part of the opening, and subsequently pulling the buckle in the principal plane thereof the spread the projections 45 and permit the stud 57 to resiliently seat in the smaller part 44 of the opening 42. It will be observed that the enlargement is now disposed between the portions 31 and 33 of the loop-forming element 12, and thus at least partially shielded to prevent contact with an outer surface 61 of an adjacent buckle 51 when a plurality of belts are suspended from the rod 20, and move relative to each other by customers examining the belts for selection. Since the device 10 is formed of soft material, the possibility of scratching the outer surface of any buckle through contact with the stud of an adjacent buckle is completely eliminated.

It will be observed that the present device may also be used selectively in a manner similar to that disclosed in our above mentioned patent without any material alteration therein.

It should be noted, that the device is also suitable for use with buckle elements of the type disclosed in which the elongated stud is not provided with an enlargement on the free end thereof. In such case, the stud is engaged in a similar manner, the free end of the stud being inserted into the larger part of the keyhole-shaped opening, and moved to the smaller part where it is frictionally retained.

We wish it to be understood that we do not consider the invention limited to the precise details of structure shown and set forth in this specification, for obvious modifications will occur to those skilled in the art to which the invention pertains.

We claim:

1. In a combination display belt hanger of resilient flexible material, including a main body having means for engaging a fixed support, and a loop-forming element depending from said main body element; and a buckle element of an individual dress belt selectively engaged with said loop-forming element, the improvement comprising: said buckle element including a generally planar main body portion having inner and outer surfaces, and an elongated stud having a free end extending laterally from said inner surface; said loop-forming element including a keyhole-shaped opening therein having a first portion of configuration corresponding to the diameter of said stud, and a second larger portion communicating therewith; said stud being engaged with said keyhole-shaped opening from an outer surface of said loop-forming member, whereby said free end is at least partially enclosed between the inner surfaces of communicating parts of said loop-forming element, and thereby shielded from accidental contact with other objects.

2. Structure in accordance with claim 1, further characterized in said elongated stud having an enlargment on said free end thereof of diameter corresponding to said second portion of said keyhole-shaped opening.

* * * * *